US010163356B2

(12) United States Patent
Britan et al.

(10) Patent No.: US 10,163,356 B2
(45) Date of Patent: Dec. 25, 2018

(54) SYSTEMS AND METHODS FOR DISPLAYING AIRCRAFT SEPARATION INFORMATION

(71) Applicant: The MITRE Corporation, McLean, VA (US)

(72) Inventors: Clark D. Britan, Arlington, VA (US); Paul A. Diffenderfer, Peachtree City, GA (US)

(73) Assignee: The MITRE Corporation, Mclean, VA (US)

( * ) Notice: Subject to any disclaimer, the term of this patent is extended or adjusted under 35 U.S.C. 154(b) by 0 days.

(21) Appl. No.: 15/203,495

(22) Filed: Jul. 6, 2016

(65) Prior Publication Data

US 2018/0012500 A1 Jan. 11, 2018

(51) Int. Cl.
*G08G 5/00* (2006.01)
*G08G 5/02* (2006.01)

(52) U.S. Cl.
CPC ..... *G08G 5/0043* (2013.01); *G08G 5/0013* (2013.01); *G08G 5/0026* (2013.01); *G08G 5/0082* (2013.01); *G08G 5/025* (2013.01)

(58) Field of Classification Search
CPC .... G08G 5/0026; G08G 5/006; G08G 5/0013; G08G 5/0043; G08G 5/0082; G08G 5/065
USPC ..... 701/120
See application file for complete search history.

(56) References Cited

U.S. PATENT DOCUMENTS 4,839,658 A * 6/1989 Kathol ..... G08G 5/0082 342/29
6,199,008 B1 * 3/2001 Aratow ..... G01C 23/00 701/120
2012/0245835 A1 * 9/2012 Weitz ..... G08G 5/0013 701/120

* cited by examiner

*Primary Examiner* — Maceeh Anwari
(74) *Attorney, Agent, or Firm* — Morrison & Foerster LLP

(57) ABSTRACT

An aircraft separation system for receiving tracking data for a plurality of aircraft from a tracking system, determining at least some of the plurality of aircraft to include in a three-dimensional awareness zone, determining a first track pair in the awareness zone comprising a first aircraft and a second aircraft of the at least some of the plurality of aircraft, wherein the first aircraft is on a first heading and the second aircraft is on a second heading that is different from the first heading, determining a separation distance between the first aircraft and the second aircraft, and displaying, on a display of the aircraft separation system, a user interface comprising a representation of the first aircraft, a representation of the second aircraft, and an indication of the separation distance between the first aircraft and the second aircraft displayed proximate to the representation of the second aircraft.

30 Claims, 9 Drawing Sheets

SYSTEMS AND METHODS FOR DISPLAYING AIRCRAFT SEPARATION INFORMATION

FIELD OF THE DISCLOSURE

This disclosure relates generally to air traffic control and more specifically to display of information to an air traffic controller.

BACKGROUND OF THE DISCLOSURE

Air traffic controllers must carefully monitor the flow of air traffic to guarantee its safety and efficiency. One of their goals can be optimizing the landing of aircraft by minimizing the time between landings, which increases runway throughput. Time between landings is controlled by the distance between aircraft. Thus, controllers can minimize the time between landings by minimizing the distance between aircraft while at the same time maintaining minimum separation distances required for safety. Without appropriate tools, air traffic controllers estimate or manually calculate aircraft separation, which can consume extra time, be imprecise, and be less efficient.

Tools are available to assist controllers in managing spacing for incoming aircraft that are on final approach. Spacing information may be displayed on an air traffic control display for aircraft that are on the final approach course. The displayed information can help air traffic controllers guide aircraft on the final approach course to minimize excess separation between aircraft while maintaining safe separation.

For many airports, the final approach course may be about 20 nautical miles long with a central axis defined by an extension of the runway centerline. An electronic beam, called the Instrument Landing System localizer, provides lateral guidance to aircraft along the final approach course. The spacing of incoming aircraft that are not yet established on the localizer is managed by controllers to minimize the later spacing on the final approach course. However, conventional systems cannot display the separation information for these aircraft because the aircraft are not lined up in an easy to determine sequence. While existing arrival management systems can support controllers by assigning arrival time for each aircraft based on the runway capacity, controllers must mentally convert this information into aircraft separation.

SUMMARY OF THE DISCLOSURE

This disclosure relates to systems and methods that can help air traffic controllers optimize aircraft landing by minimizing the excess distance between aircraft without losing the minimum separation distance required for safe landing. According to some embodiments, spacing information is displayed on an air traffic control display, such as a radar display, for incoming aircraft before they reach the final approach course. This information can be used by controllers to manage the distance between aircraft, increasing landing efficiency and safety.

According to some embodiments, a predefined awareness zone is established, and the system displays spacing information for approaching aircraft that are within the predefined awareness zone. The aircraft may have headings that differ from one another and that differ from a final approach heading because the aircraft are included in the analysis earlier in their path to the final approach course. Because distances and minimum separation requirements may be identified prior to an aircraft being established on the final approach course, systems and methods described herein can help air traffic controllers manage incoming aircraft sooner, leading to better spacing on the final approach course and increased runway throughput.

Systems and methods according to some embodiments can be particularly useful in cases with a high number of aircraft arrivals, since such airports generally experience high congestion. In these cases, approaching air traffic is managed by air traffic controllers, who are sometimes required to make split-second decisions. By displaying aircraft separation information for approaching aircraft sooner than conventional systems, air traffic controllers can make decisions earlier allowing them to more easily manage approaching aircraft and optimize separation distances. Systems and methods described herein can continuously receive updated location information and automatically update the user interface based on this updated information.

According to some embodiments, an aircraft separation system includes one or more processors, memory, and one or more programs, wherein the one or more programs are stored in the memory and configured to be executed by the one or more processors, the one or more programs including instructions for receiving tracking data for a plurality of aircraft from one or more tracking systems, determining at least some of the plurality of aircraft to include in a three-dimensional awareness zone based on the tracking data, wherein the awareness zone encompasses at least a portion of a final approach course, determining a first track pair in the awareness zone comprising a first aircraft of the at least some of the plurality of aircraft and a second aircraft of the at least some of the plurality of aircraft, wherein the first aircraft is on a first heading and the second aircraft is on a second heading that is different from the first heading, determining a separation distance between the first aircraft and the second aircraft of the first track pair, and displaying, on a display of the aircraft separation system, a user interface comprising a representation of the first aircraft, a representation of the second aircraft, and an indication of the separation distance between the first aircraft and the second aircraft displayed proximate to the representation of the second aircraft.

In any of these embodiments, the tracking data can comprise latitude, longitude, and altitude. In any of these embodiments, determining the at least some of the plurality of aircraft to include in the three-dimensional awareness zone can include determining that altitudes of the at least some of the plurality of aircraft are less than a pre-determined threshold.

In any of these embodiments, determining the at least some of the plurality of aircraft to include in the three-dimensional awareness zone can include determining that headings of the at least some of the plurality of aircraft are outside of a pre-determined range. In any of these embodiments, the pre-determined range can be relative to a final approach course heading.

In any of these embodiments, the one or more programs can include instructions for: receiving tracking data for a third aircraft from one or more tracking systems, determining to include the third aircraft in the three-dimensional awareness zone based on the tracking data for the third aircraft, determining a second track pair in the awareness zone, wherein the second track pair comprises the second aircraft having the second heading and the third aircraft having a third heading, wherein the third heading is different from the first heading and the second heading, determining a separation distance between the second aircraft and the third aircraft of the second track pair, and automatically updating the user interface to display a representation of the third aircraft and an indication of the separation distance between the second aircraft and the third aircraft displayed proximate to the representation of the third aircraft.

In any of these embodiments, the user interface can include a graphical indication of a minimum separation distance for the second aircraft. In any of these embodiments, the graphical indication of the minimum separation distance for the second aircraft can be an indicator displayed proximate to the representation of the second aircraft.

In any of these embodiments, a size of the indicator can be proportional to the minimum separation distance. In any of these embodiments, the graphical indication of the minimum separation distance for the second aircraft can indicate a heading for the second aircraft.

In any of these embodiments, the one or more programs can include instructions for alerting a user when the second aircraft has entered a predefined alerting zone and there is a predicted loss of separation between the first aircraft and the second aircraft within a predetermined time or when the separation distance between the first aircraft and the second aircraft is within a pre-determined threshold of the minimum separation distance of the second aircraft.

In any of these embodiments, a size and shape of the awareness zone can be user configurable. In any of these embodiments, the user interface can include an indication of landing sequence, aircraft type, and wake turbulence category associated with the second aircraft and the indication is displayed proximate to the representation of the second aircraft. In any of these embodiments, the one or more programs can include instructions for receiving updated tracking data and automatically updating the user interface based on the updated tracking data.

According to some embodiments, a method of displaying aircraft separation on a display of an air traffic control system includes receiving tracking data for a plurality of aircraft from one or more tracking systems, determining at least some of the plurality of aircraft to include in a three-dimensional awareness zone based on the tracking data, wherein the awareness zone encompasses at least a portion of a final approach course, determining a first track pair in the awareness zone comprising a first aircraft of the at least some of the plurality of aircraft and a second aircraft of the at least some of the plurality of aircraft, wherein the first aircraft is on a first heading and the second aircraft is on a second heading that is different from the first heading, determining a separation distance between the first aircraft and the second aircraft of the first track pair, and displaying, on a display of the aircraft separation system, a user interface comprising a representation of the first aircraft, a representation of the second aircraft, and an indication of the separation distance between the first aircraft and the second aircraft displayed proximate to the representation of the second aircraft.

In any of these embodiments, the tracking data can comprise latitude, longitude, and altitude. In any of these embodiments, determining the at least some of the plurality of aircraft to include in the three-dimensional awareness zone can include determining that altitudes of the at least some of the plurality of aircraft are less than a pre-determined threshold.

In any of these embodiments, determining the at least some of the plurality of aircraft to include in the three-dimensional awareness zone can include determining that headings of the at least some of the plurality of aircraft are outside of a pre-determined range. In any of these embodiments, the pre-determined range can be relative to a final approach course heading.

In any of these embodiments, the method can include receiving tracking data for a third aircraft from one or more tracking systems, determining to include the third aircraft in the three-dimensional awareness zone based on the tracking data for the third aircraft, determining a second track pair in the awareness zone, wherein the second track pair comprises the second aircraft having the second heading and the third aircraft having a third heading, wherein the third heading is different from the first heading and the second heading, determining a separation distance between the second aircraft and the third aircraft of the second track pair, and automatically updating the user interface to display a representation of the third aircraft and an indication of the separation distance between the second aircraft and the third aircraft displayed proximate to the representation of the third aircraft.

In any of these embodiments, the user interface can include a graphical indication of a minimum separation distance for the second aircraft. In any of these embodiments, the graphical indication of the minimum separation distance for the second aircraft can be an indicator displayed proximate to the representation of the second aircraft.

In any of these embodiments, a size of the indicator can be proportional to the minimum separation distance. In any of these embodiments, the graphical indication of the minimum separation distance for the second aircraft can indicate a heading for the second aircraft.

In any of these embodiments, the method can include alerting a user when the second aircraft has entered a predefined alerting zone and there is a predicted loss of separation between the first aircraft and the second aircraft within a predetermined time or when the separation distance between the first aircraft and the second aircraft is within a pre-determined threshold of the minimum separation distance of the second aircraft. In any of these embodiments, a size and shape of the awareness zone can be user configurable.

In any of these embodiments, the user interface can include an indication of landing sequence, aircraft type, and wake turbulence category associated with the second aircraft and the indication is displayed proximate to the representation of the second aircraft. In any of these embodiments, the method can include receiving updated tracking data and automatically updating the user interface based on the updated tracking data.

According to some embodiments, a non-transitory computer readable storage medium comprises one or more programs, which when executed by a system with a display, cause the system to receive tracking data for a plurality of aircraft from one or more tracking systems, determine at least some of the plurality of aircraft to include in a three-dimensional awareness zone based on the tracking data, wherein the awareness zone encompasses at least a portion of a final approach course, determine a first track pair in the awareness zone comprising a first aircraft of the at least some of the plurality of aircraft and a second aircraft of the at least some of the plurality of aircraft, wherein the first aircraft is on a first heading and the second aircraft is on a second heading that is different from the first heading, determine a separation distance between the first aircraft and the second aircraft of the first track pair, and display on the aircraft control system display a user interface comprising a representation of the first aircraft, a representation of the second aircraft, and an indication of the separation distance between the first aircraft and the second aircraft displayed proximate to the representation of the second aircraft.

In any of these embodiments, the tracking data can comprise latitude, longitude, and altitude. In any of these embodiments, determining the at least some of the plurality of aircraft to include in the three-dimensional awareness zone can include determining that altitudes of the at least some of the plurality of aircraft are less than a pre-determined threshold.

In any of these embodiments, determining the at least some of the plurality of aircraft to include in the three-dimensional awareness zone can include determining that headings of the at least some of the plurality of aircraft are outside of a pre-determined range. In any of these embodiments, the pre-determined range can be relative to a final approach course heading.

In any of these embodiments, the one or more programs can include instructions that cause the system to receive tracking data for a third aircraft from one or more tracking systems, determine to include the third aircraft in the three-dimensional awareness zone based on the tracking data for the third aircraft, determine a second track pair in the awareness zone, wherein the second track pair comprises the second aircraft having the second heading and the third aircraft having a third heading, wherein the third heading is different from the first heading and the second heading, determine a separation distance between the second aircraft and the third aircraft of the second track pair, and automatically update the user interface to display a representation of the third aircraft and an indication of the separation distance between the second aircraft and the third aircraft displayed proximate to the representation of the third aircraft.

In any of these embodiments, the user interface can include a graphical indication of a minimum separation distance for the second aircraft. In any of these embodiments, the graphical indication of the minimum separation distance for the second aircraft can be an indicator displayed proximate to the representation of the second aircraft.

In any of these embodiments, a size of the indicator can be proportional to the minimum separation distance. In any of these embodiments, the graphical indication of the minimum separation distance for the second aircraft can indicate a heading for the second aircraft.

In any of these embodiments, the one or more programs can include instructions that cause the device to alert a user when there is a predicted loss of separation between the first aircraft and the second aircraft within a predetermined time or when the separation distance between the first aircraft and the second aircraft is within a pre-determined threshold of the minimum separation distance of the second aircraft. In any of these embodiments, a size and shape of the awareness zone can be user configurable.

In any of these embodiments, the user interface can include an indication of landing sequence, aircraft type, and wake turbulence category associated with the second aircraft and the indication is displayed proximate to the representation of the second aircraft. In any of these embodiments, the one or more programs can include instructions that cause the system to receive updated tracking data and automatically updating the user interface based on the updated tracking data.

DETAILED DESCRIPTION OF THE INVENTION

Described herein are systems and methods for displaying aircraft separation information for aircraft established on a final approach course and aircraft that are approaching a final approach course. In some embodiments, the distance between two approaching aircraft can be determined and displayed, precluding the need for the air traffic controller to manually calculate or estimate the distance. According to some embodiments, a graphical indication of the required minimum separation distance can also be displayed and can be used to alert an air traffic controller when a minimum separation distance is lost or predicted to be lost.

Figure 1A:
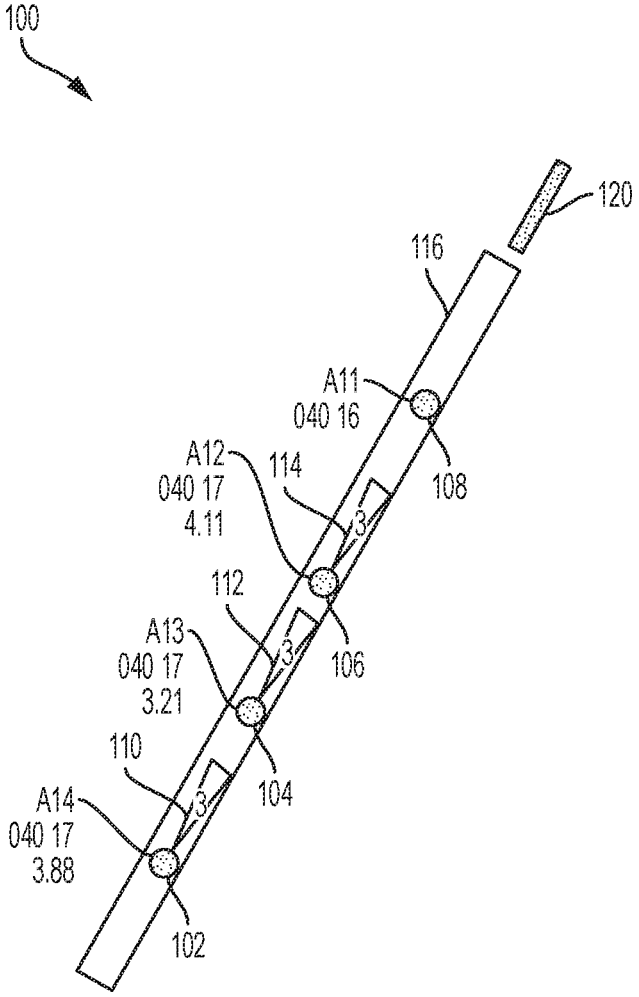
FIG. 1A illustrates an exemplary user interface displaying aircraft on a final approach course using a conventional system.

Minimum spacing must be maintained between aircraft that are approaching an airport to ensure safety. Air traffic controllers control approaching aircraft to minimize the excess spacing between the aircraft to minimize the time between landings, increasing the runway throughput. Controllers must ensure that minimum separation between aircraft is maintained to ensure safety. Tools exist to aid air traffic controllers in this task by graphically representing approaching aircraft and displaying information relevant to the spacing of the aircraft. For example, FIG. 1A illustrates a user interface that is exemplary of existing tools for displaying spacing information for approaching aircraft. User interface 100 includes indicators 102, 104, 106, and 108, which are associated with respective aircraft approaching runway 120, with aircraft 108 being closest to the runway. For simplicity, the indicators are referred to below as aircraft 102, aircraft 104, etc., and a similar descriptive scheme for indicators associated with approaching aircraft is used throughout the disclosure.

All four aircraft are on a final approach course 116. A final approach course is an aircraft's last leg of a flight, when the aircraft is lined up with the runway and descending for landing. Often, the boundaries of the final approach course are based on the features of an instrument landing system that an airport uses to guide aircraft into landing. An instrument landing system operates as ground-based instrument approach system that provides precision lateral and vertical guidance to an aircraft approaching and landing on a runway, for example, using directional radio signals. These landing systems ensure that the aircraft are in line with the runway, on the correct heading, and following a prescribed lateral path and descent profile. Aircraft enter the final approach course often within about 20 nautical miles of an airport. But the length of the final approach course can be different for different airports and varies, for example, based on the distance that the instrument landing system can accurately be used by aircraft (e.g., as affected by terrain, signal obstructions, weather, etc.).

Aircraft 102 is furthest from the runway of the four aircraft illustrated in FIG. 1A. The minimum required separation distance 110 for aircraft 102 is 3 nautical miles based on the wake turbulence categories of the aircraft. Thus, aircraft 102 must stay at least 3 nautical miles behind the aircraft in front of it, aircraft 104, to ensure a safe landing. The minimum separation distances 112 and 114 for aircraft 104 and 106, respectively, are also 3 nautical miles each. The graphical indications of minimum separation distances 110, 112, and 114 are cones displayed proximately to aircraft 102, 104, and 106, respectively. Minimum separation distances 110, 112, and 114 are oriented to indicate the heading of the aircraft. As illustrated, the minimum separation distances 110, 112, and 114 are oriented in the same direction, since the aircraft of FIG. 1A are all on the final approach course. As such, aircraft 102, 104, and 106 all have similar headings.

Figure 1B:
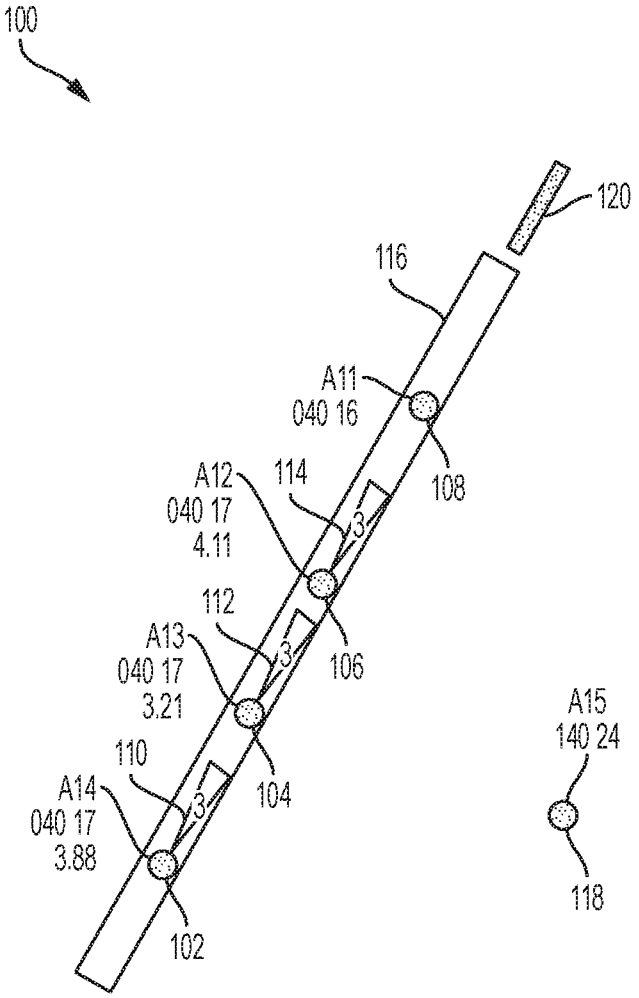
FIG. 1B illustrates another exemplary user interface of incoming aircraft that are on a final approach course and approaching a final approach course using a conventional system.

The conventional tool exemplified by FIG. 1 is limited to displaying spacing information for only those aircraft that are on the final approach course (i.e., within the range of the instrument landing system) because the landing sequence is only easily determinable for those aircraft on the final approach course. For example, FIG. 1B illustrates another exemplary display of a conventional system, with an approaching aircraft 118. As illustrated, aircraft 118 is not on the final approach course—it is not within the bounds of the final approach course nor does it have a final approach heading. Thus, according to conventional system 100, spacing information for aircraft 118 is not displayed on the user interface.

Displaying separation information for incoming aircraft earlier in the approach is desirable. The sooner this information can be accurately obtained and displayed, the better an air traffic controller can arrange incoming aircraft such that the separation between aircraft on the final approach course is minimized, which results in more efficient landing sequences. This is particularly important for the world's busiest airports. Systems and methods described herein can help achieve this goal, in part by displaying spacing information for aircraft that are approaching an airport but not on a final approach course.

In the following description of the disclosure and embodiments, reference is made to the accompanying drawings, in which are shown, by way of illustration, specific embodiments that can be practiced. It is to be understood that other embodiments and examples can be practiced, and changes can be made without departing from the scope of the disclosure.

In addition, it is also to be understood that the singular forms "a," "an," and "the" used in the following description are intended to include the plural forms as well, unless the context clearly indicates otherwise. It is also to be understood that the term "and/or" as used herein refers to and encompasses any and all possible combinations of one or more of the associated listed items. It is further to be understood that the terms "includes, "including," "comprises," and/or "comprising," when used herein, specify the presence of stated features, integers, steps, operations, elements, components, and/or units but do not preclude the presence or addition of one or more other features, integers, steps, operations, elements, components, units, and/or groups thereof.

However, all of these and similar terms are to be associated with the appropriate physical quantities and are merely convenient labels applied to these quantities. Unless specifically stated otherwise as apparent from the following discussion, it is appreciated that, throughout the description, discussions utilizing terms such as "processing," "computing," "calculating," "determining," "displaying," or the like, refer to the action and processes of a computer system, or similar electronic computing device, that manipulates and transforms data represented as physical (electronic) quantities within the computer system memories or registers or other such information storage, transmission, or display devices.

The present invention also relates to a device for performing the operations herein. This device may be specially constructed for the required purposes, or it may comprise a general-purpose computer selectively activated or reconfigured by a computer program stored in the computer. Such a computer program may be stored in a non-transitory, computer-readable storage medium, such as, but not limited to, any type of disk, including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Furthermore, the computers referred to in the specification may include a single processor or may be architectures employing multiple processor designs for increased computing capability.

The methods, devices, and systems described herein are not inherently related to any particular computer or other apparatus. Various general-purpose systems may also be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein.

Throughout the disclosure, reference is often made to use the systems and methods or aspects of the systems and methods described herein for displaying aircraft separation, for example, for aircraft approaching an airport for landing. However, reference to aircraft separation is for illustration purposes only and is not meant to be limiting. Embodiments of systems and methods described herein can be used for any system, group of systems, installation, group of installations, facility, group of facilities, etc., in which there is a need for displaying separation data. For example, systems and methods can be used to display separation data for trucks approaching a shipping facility or other location or group of locations, to display separation data for trains of a transit system or other system or systems, to display separation data for goods through a factory or other facility or group of facilities, and/or to display separation data for any other asset through a limited set of defined resources.

Described below are early separation awareness systems and methods, according to some embodiments, for displaying aircraft separation information for aircraft approaching one or more airports. These systems and methods may be used for any scale of air traffic control operations and can display aircraft separation information automatically and continuously.

Systems

Figure 2:
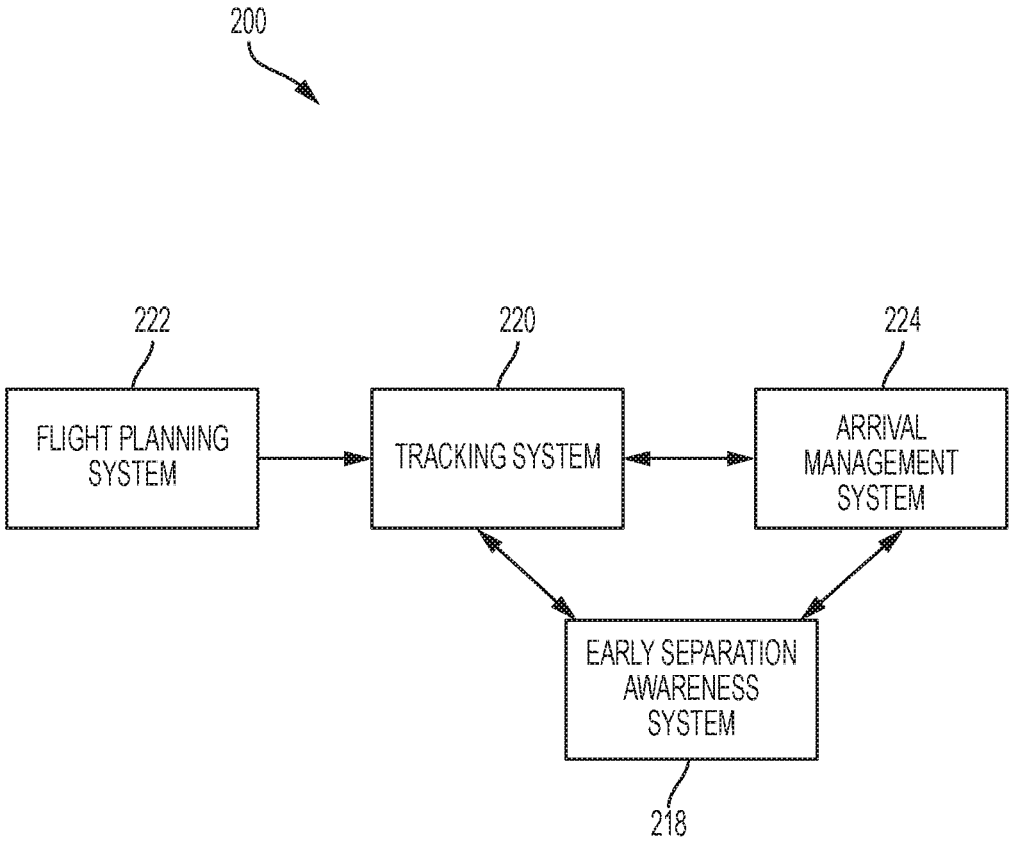
FIG. 2 illustrates a system, according to some embodiments.

FIG. 2 illustrates an air traffic control system 200 that includes early separation awareness system 218 according to one embodiment. Early separation awareness system 218 can gather information about incoming aircraft and display spacing information that air traffic controllers can use to guide the aircraft such that spacing is minimized but maintained. Early separation awareness system 218 can be communicatively coupled to one or more aircraft tracking systems 220. The aircraft tracking system 220 may track and communicate with aircraft within a tracking zone. The aircraft tracking system 220 may include one or more systems for communicating with and tracking aircraft. For example, aircraft tracking system 220 may include one or more radar based systems, satellite systems, radio communication systems, etc. The aircraft tracking system 220 gathers data for identifying aircraft, determining aircraft lateral location, altitude, heading, speed, and any other data relevant to controlling the approach of an aircraft.

Early separation awareness system 218 receives information for approaching aircraft from aircraft tracking system 220 and uses the received information to provide controllers with spacing information that they can use to help guide approaching aircraft. In some embodiments, tracking system 220 receives information from one or more flight planning systems 222 that maintain information (such as flight plans) that can be used to identify which aircraft within the vicinity of the approach control system are scheduled for landing (e.g., as opposed to merely flying within the airspace but headed to another destination).

Early separation awareness system 218, in some embodiments, leverages the sequence information from arrival management system 224. This information can assist the early separation awareness system in determining the arrival sequence of the aircraft.

Early separation awareness system 218 uses information received from aircraft tracking system 220 (and, in some embodiments, arrival management system 224) to display information to air traffic controllers for maximizing the landing efficiency of approaching aircraft while maintaining safe separation. Early separation awareness system 218 may include one or more processors, memory, a display, one or more user input devices, and may be communicatively coupled to one or more other air traffic control systems through a communication network.

Figure 3A:
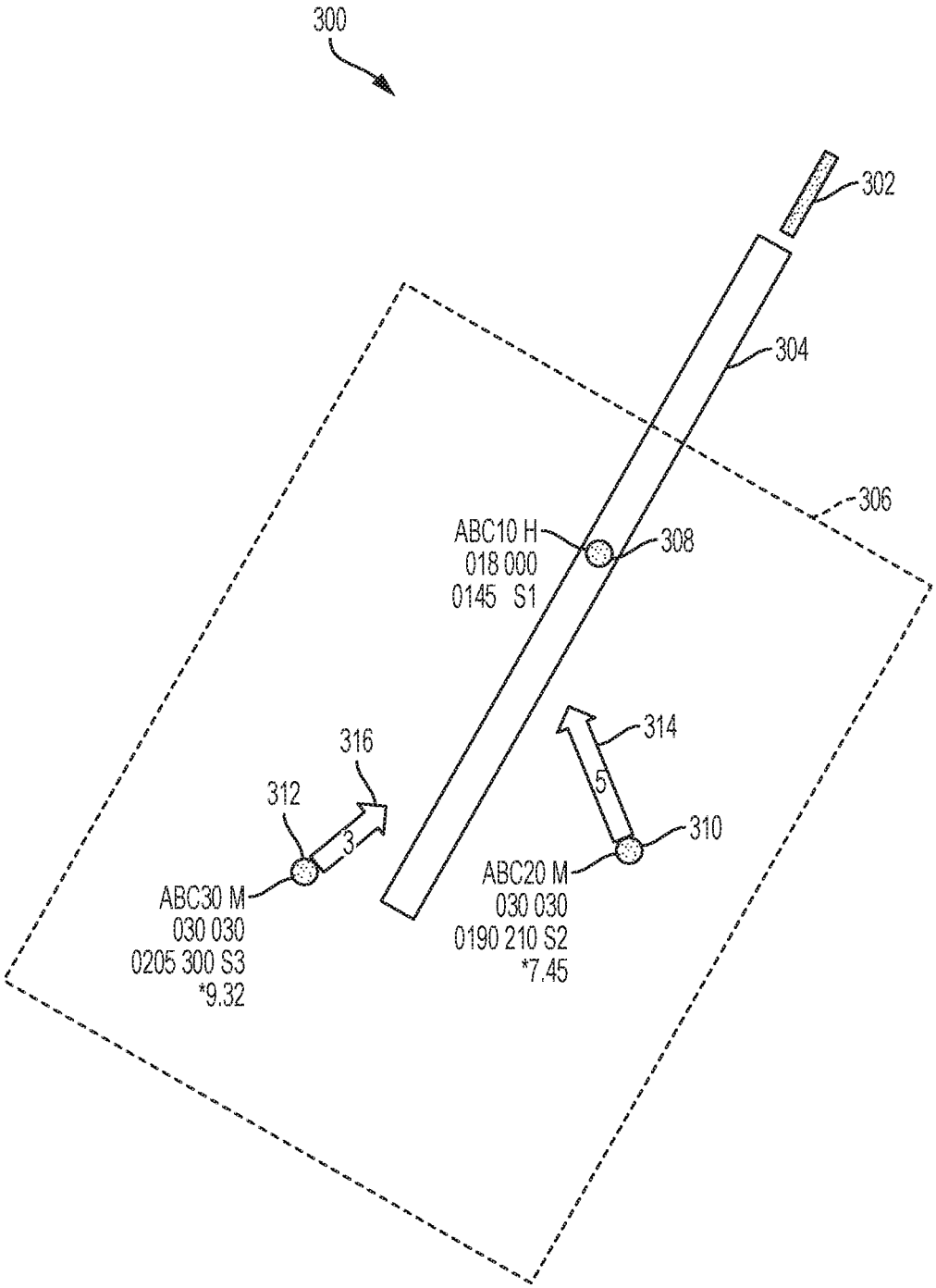
FIG. 3A illustrates an exemplary user interface displaying spacing for incoming aircraft, according to some embodiments.

FIG. 3A illustrates an exemplary user interface (300) displaying approaching aircraft spacing information, according to some embodiments. User interface 300 may be displayed on a display of the early separation awareness system 218 or some other display that is communicatively coupled to early separation awareness system 218. In some embodiments, user interface 300 is displayed on a display of flight tracking system 220.

User interface 300 includes runway 302, alerting zone 304, aircrafts 308, 310, and 312, and awareness zone 306. Aircraft 308 is approaching runway 302 on final approach course 304. Displayed proximate to aircraft 308 is information relevant to aircraft 308 including the flight number, relative size of the aircraft, and landing sequence. The "S1" displayed proximate to aircraft 308 indicates that aircraft 308 is first in line to land on runway 302. The "S2" displayed proximate to aircraft 310 indicates that aircraft 310 is second in line to land on runway 302.

The distance between aircraft 308 and aircraft 310 is determined by generating a track pair of the two aircraft. A track pair can be determined by using sequencing information and pairing aircraft that are in relative succession. Sequencing information may be predetermined and obtained, for example, from arrival management system 224 or may be generated by early separation awareness system 218. In any given track pair, the aircraft with an earlier sequence position is the leading aircraft, and the aircraft with the later sequence position is the trailing aircraft. A given aircraft can be the trailing aircraft in only one track pair, but can be a leading aircraft in another track pair, and vice versa.

In the track pair of aircraft 308 and 310, aircraft 308 is the leading aircraft and aircraft 310 is the trailing aircraft. The distance between leading aircraft 308 and trailing aircraft 310, which is 7.45 nautical miles (this may be the two-dimensional distance between the aircraft that does not include altitude differences), and is calculated by the early separation awareness system and displayed proximate to trailing aircraft 310. The asterisk preceding the distance value indicates that the distance displayed is a distance between two aircraft of a track pair, wherein aircraft 310 is the trailing aircraft of the track pair. An asterisk is shown for exemplary purposes only. Any graphical indication may be used, including symbols, letters, numbers, colors, etc.

Another track pair is generated with aircraft 310 and 312. In this track pair, aircraft 310 is now the leading aircraft and aircraft 312 is the trailing aircraft. The distance between leading aircraft 310 and trailing aircraft 312 is 9.32 nautical miles, which is displayed proximate to the trailing aircraft of the track pair, aircraft 312. This distance is also denoted with an asterisk, since it is a distance between a leading aircraft and a trailing aircraft of a track pair.

Required separation indicator 314 is a graphical indication of the minimum separation distance of aircraft 310. In this example, an arrow is used as the indicator. The number five displayed in required separation indicator 314 indicates that a minimum separation distance of 5 nautical miles is required between aircraft 310 and aircraft 308. It is displayed proximate to the representation of aircraft 310. Similarly, required separation indicator 316 is a graphical indication of the minimum separation distance of aircraft 312 (3 nautical miles), and is displayed proximate to aircraft 312. The minimum separation distance is a minimum distance an aircraft must maintain between it and an aircraft in front of it to land safely and may be based on the wake turbulence categories of the aircraft. Thus, to land safely, aircraft 310 must maintain a distance of at least 5 nautical miles between it and aircraft 308 in front of it, and aircraft 312 must maintain a distance of at least 3 nautical miles between it and aircraft 310 in front of it.

According to some embodiments, the minimum separation distance can be a predetermined value assigned to specific aircraft based on the size of the wake the leading aircraft generates and the size of the trailing aircraft. This minimum separation could be reduced by cross winds that reduce the impact of the wake on training aircraft. These minimum separation requirements are subject to change as more knowledge is gained on aircraft wake. In this embodiment, required separation indicator 314 is larger than required separation indicator 316 because the aircraft pair associated with required separation indicator 314 is a medium aircraft followed by a heavy aircraft, whereas the pair associated with required separation indicator 316 is a medium aircraft followed by a medium aircraft. The mapping of minimum separation by aircraft type is adaptable to reflect changes in criteria and standards.

As illustrated in FIG. 3A, the graphical indications of minimum separation distances, required separation indicators 314 and 316, are not oriented in the same direction. According to this embodiment, the graphical representations of minimum separation distance indicate heading. Thus, because aircraft 310 and 312 are heading in different directions, required separation indicators 314 and 316 are oriented in different directions. Even though aircraft 310 and 312 are not on the final approach course and have different headings, they are still approaching the runway for landing. Thus, the relevant information displayed proximate to aircraft 310 and 312 is pertinent to an aircraft controller managing incoming aircraft.

User interface 300 includes a pre-defined awareness zone 306. This awareness zone encompasses at least a portion of the final approach course, or alerting zone 304. Systems and methods accordingly to some embodiments can use an awareness zone to expand the display of separation visual aids beyond the final approach course.

Systems and methods according to the embodiment portrayed in FIG. 3A can use the received tracking information to determine that aircraft 308, 310, and 312 are all located within the pre-defined awareness zone 306. In FIG. 3A, information relevant to approach control is displayed proximate to the representation of each aircraft accordingly.

Figure 3B:
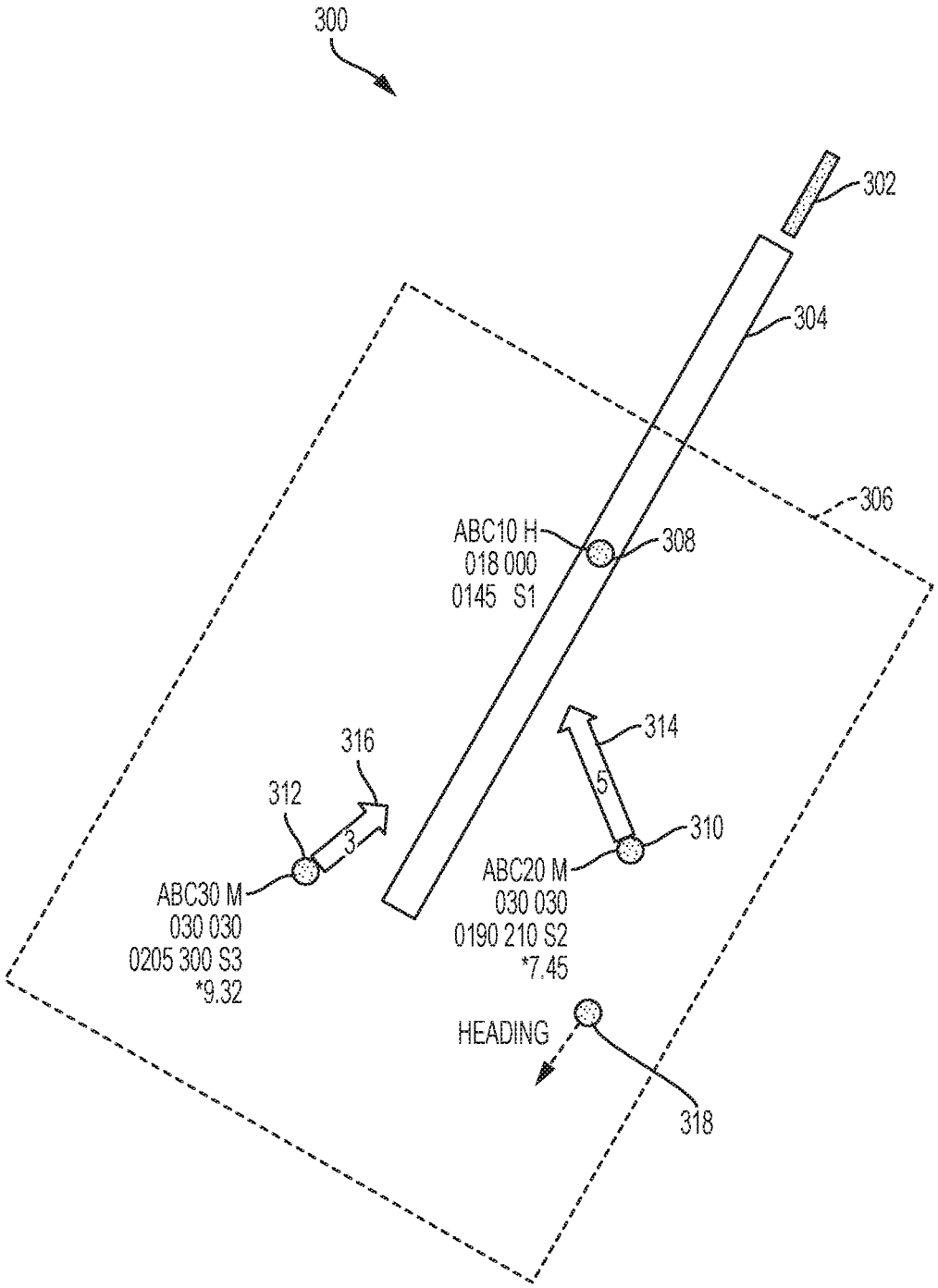
FIG. 3B illustrates an exemplary user interface displaying spacing for incoming aircraft in which an aircraft not approaching the airport is excluded, according to some embodiments.

FIG. 3B illustrates a similar user interface to that of FIG. 3A. However, aircraft 318 is physically located within the predefined awareness zone 306, but does not have any relevant location or separation information displayed proximate to it. Aircraft 318 has a heading (as indicated by the arrow displayed proximate to aircraft 318) that does not fall within a pre-defined range of headings relative to the final approach heading. Thus, accordingly to this embodiment, aircraft 318 was excluded from the display of separation aids. The pre-defined range of headings can be user configurable and can be asymmetric, meaning that if the final approach heading is at zero, the pre-defined heading range can be 120 degrees left of zero and 120 degrees right of zero, or it can be 90 degrees left of zero and 120 degrees right of zero, for example. Thus, systems and methods according to this embodiment can prevent the user interface from becoming cluttered with irrelevant information.

Other embodiments can determine that an aircraft is not an approaching aircraft based on altitude. If an aircraft's altitude does not fall within the pre-defined dimensions of the awareness zone, systems and methods according to some embodiments can exclude such an aircraft from the display of visual separation aids. For example, an aircraft at an altitude above a predetermined threshold may not be included in the awareness zone.

Figure 3C:
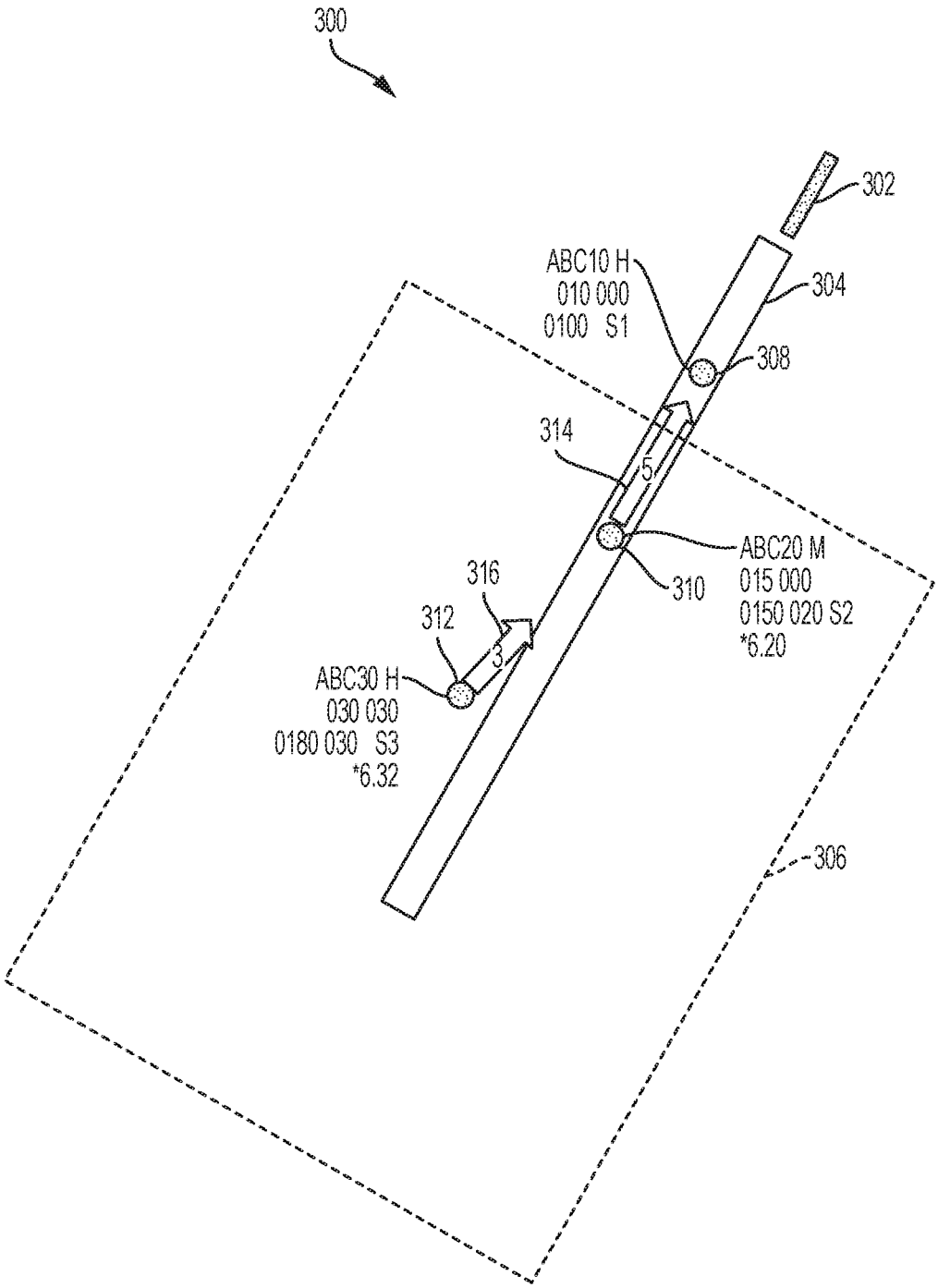
FIG. 3C illustrates an exemplary user interface displaying spacing for incoming aircraft in which a visual alert is provided based on a predicted loss of minimum separation distance, according to some embodiments.

FIG. 3C illustrates a user interface with two aircraft, aircraft 308 and aircraft 310 on the final approach course. Aircraft 312 is an approaching aircraft located within the awareness zone. Required separation indicator 314 is displayed proximate to aircraft 310, indicating that aircraft 310 must remain at least 5 nautical miles from the aircraft landing in front of it, in this case aircraft 308. However, the distance between aircraft 308 and 310 in FIG. 3B was 7.45 nautical miles. Now, the distance between aircraft 308 and 310 is only 6.20 nautical miles, displayed proximate to aircraft 310.

Systems and methods according to the embodiment of FIG. 3C can visually alert an air traffic controller when a loss of required separation is predicted within a predetermined time (e.g., 45 seconds). This alert only occurs for aircraft within the alerting zone 304. In this embodiment, the graphical indication of the minimum required separation distance, required separation indicator 314, changes color (not shown) to visually alert the air traffic controller to this situation. According to other embodiments, the graphical indication of the minimum required separation distance can change to a third color when the predicted loss of separation is predicted within a smaller predetermined time (e.g., 22 seconds).

In other embodiments, the graphical indication of the minimum separation distance can change shape, change size, or flash to visually alert the air traffic controller.

Even though the distance between aircraft 310 and 312 of FIG. 3C is 6.32 nautical miles, and aircraft 312 is only required to maintain a minimum separation distance of 3 nautical miles, the graphical indication of minimum separation distance, required separation indicator 316, does alert (not shown) the air traffic controller, because the distance between aircraft 310 and aircraft 312 is predicted to be less than 3 nautical miles within a predetermined period of time and both aircraft are within the alerting zone 304.

Figure 4:
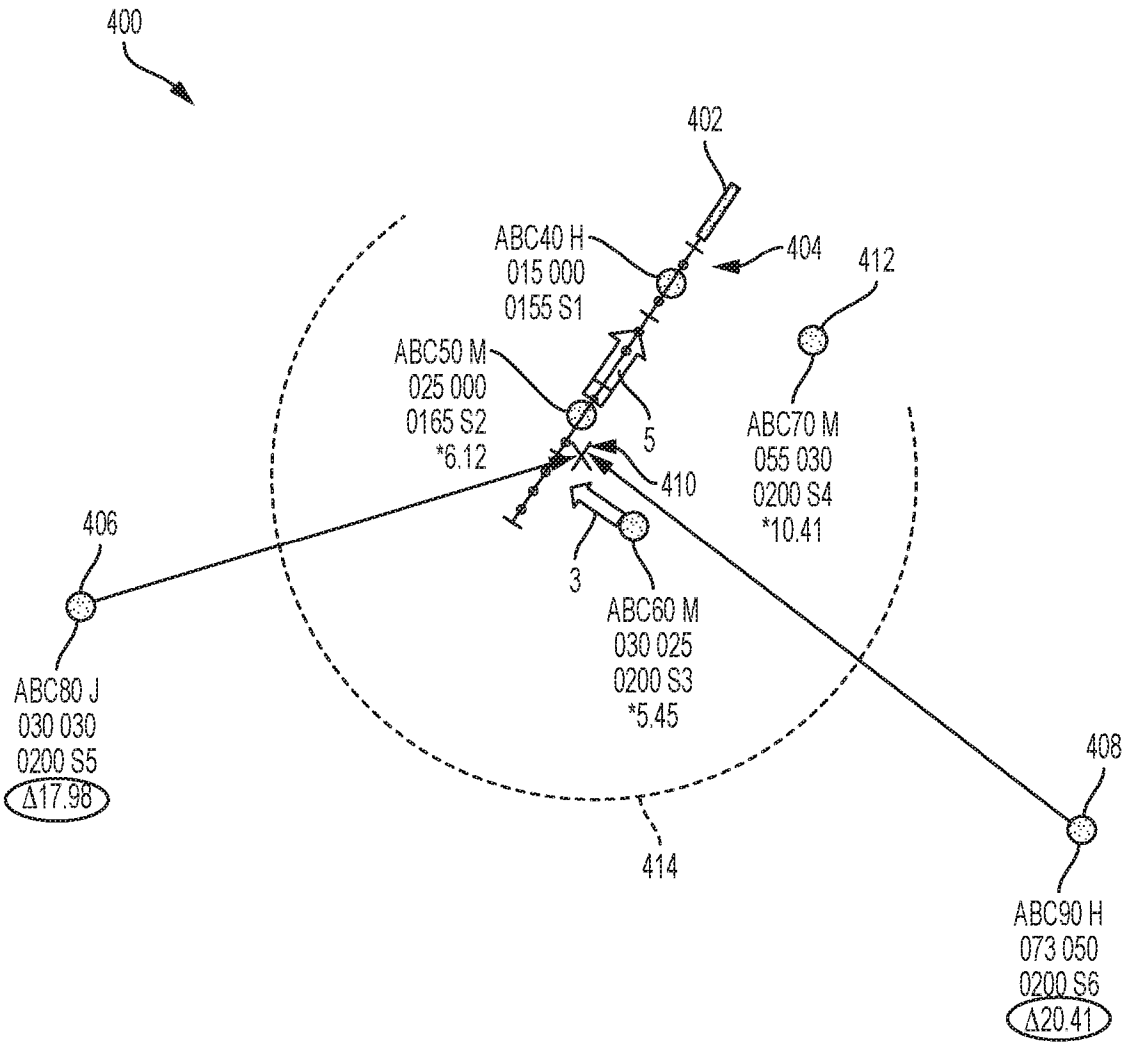
FIG. 4 illustrates an exemplary user interface displaying spacing for incoming aircraft using a predefined point, according to some embodiments.

In some situations, the distance between a distant aircraft and a predetermined location might be more useful to an aircraft controller than the distance between that distant aircraft and another aircraft of a track pair. User interface 400 of FIG. 4 illustrates one embodiment of the systems and methods described herein where distances between distant aircraft and a predetermined location are determined and displayed instead of distances between the distant aircraft and another aircraft. This may be useful where the distant aircraft are far enough away that the distance to the preceding aircraft in the landing sequence would not be meaningful or useful.

As illustrated, two aircraft are on the final approach course 404, and representations of four aircraft not on the final approach course are displayed. In particular, aircraft 406 and 408 are located furthest away from runway 402 and are outside the predetermined range circle 414. Systems and methods according to this embodiment can determine and display the distance between each of these more distant aircraft and a predetermined central location 410. In some embodiments, this distance can be displayed prior to the required separation indicators appearing in front of the aircraft based on the adaption of the invention for a given airport/use. For example, there can be a large zone where the distance appears and a smaller zone, closer to the airport where the required separation indicators are displayed.

For example, the distance between distant aircraft 406 and predetermined location 410 is determined and displayed proximate to the representation of aircraft 406. The distance is 17.98 nautical miles and is preceded by a delta to indicate that this is a different distance measurement than distances displayed with an asterisk. A delta is shown for exemplary purposes only. Any graphical indication may be used, including symbols, letters, numbers, colors, etc. As described above, an asterisk according to some embodiments indicates a distance between two aircraft of a track pair. According to some embodiments, this distance between aircraft 406 and predetermined location 410 can be more useful to an air traffic controller than the distance between aircraft 406 and the aircraft landing in front of it, aircraft 412. (Aircraft 412 is labeled with "S4," meaning that it is sequenced directly in front of aircraft 406, with is labeled with "S5.")

Similarly, the distance between aircraft 408 and predetermined location 410 is 20.41 nautical miles, which is displayed proximate to the representation of aircraft 408. This distance is also indicated by a delta to visually communicate to the air traffic controller that this is a distance between an aircraft and a predetermined location.

Methods

Figure 5:
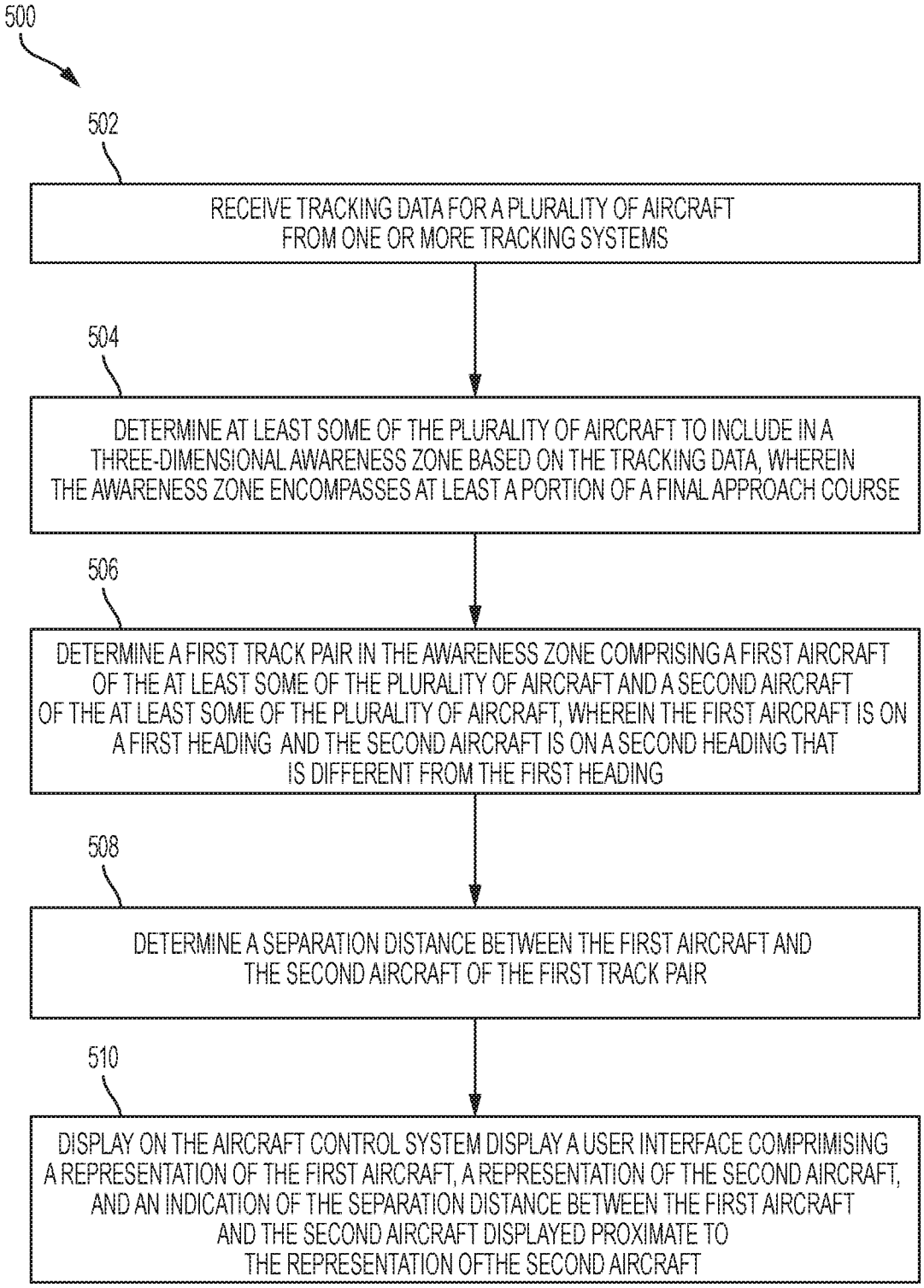
FIG. 5 illustrates a method, according to some embodiments.

FIG. 5 is a block diagram illustrating method 500 for displaying separation information for aircraft approaching for landing. Method 500 can be performed by one or more systems such as early separation awareness system 218 of FIG. 2. The steps of method 500 can be continuously and automatically repeated by systems to present air traffic controllers with the latest information. The information may be used by air traffic controllers to help minimize the excess spacing between approaching aircraft beginning at a much earlier stage for arriving aircraft than conventional systems such as those described above with respect to FIGS. 1A and 1B accommodate.

At step 502, tracking data for a plurality of aircraft is received from one or more tracking systems. For example, tracking data can be received for all aircraft that are within radar range of an aircraft tracking system associated with an air traffic control facility. The tracking data can include lateral position, altitude, aircraft identification, aircraft speed, heading, or any other information that may pertain to an approaching aircraft.

At step 504, at least some aircraft of the plurality of aircraft are determined to be within a predefined awareness zone based on the tracking information. The predefined awareness zone can be a predefined three-dimensional volume with a fixed spatial location that is used to define the aircraft that are used in the display of spacing information. The predefined awareness zone can be defined, generally, by width, length, and altitude. The predefined awareness zone may include some or all of a final approach course, may be oriented symmetrically with the final approach course (i.e. extend to equal amounts on either side of the approach course), and may be non-uniform (e.g., tapered, multi-sided, etc.). Additionally, there may be a plurality of awareness zones that exhibit different behavior (i.e., different heading or altitude filters, different geographical locations, different separation aids that are displayed).

Aircraft may be determined to be within the predefined awareness zone based on their lateral location, altitude, and heading. In some embodiments, other factors may be taken into consideration, such as flight plans, which may be used to determine whether an aircraft is landing at a particular airport or the runway of interest.

In some embodiments, the early separation awareness system determines headings for each aircraft of the plurality of aircraft. Headings may be received from one or more tracking systems or may be calculated by the early separation awareness system based on changes in position over time. In some embodiments, whether to include or exclude an aircraft from the awareness zone is based on whether the heading is within a predefined range of the final approach heading. For example, the predefined range may be within +/−90 degrees from the final approach course heading, +/−120 degrees from the final approach course heading, or any other predefined range. The range may be asymmetrical, such as +90/−70 degrees, and may be dependent on the location of the aircraft (i.e., depending on which awareness zone the aircraft is in).

After determining which aircraft to include in the predefined awareness zone, and thus, in the analysis, the system determines track pairs in step 506. As explained above, a track pair includes a leading aircraft and the aircraft that is immediately next in approach. Track pairs may be determined based on the sequence calculated by an arrival management system. For example, a first track pair includes the first and second aircraft in line for landing, and a second track pair includes the second and third aircraft in line for landing. In some embodiments, the landing sequence is generated by the early separation awareness system, for example, based on relative proximity to the airport, speed, heading, aircraft size, or any other factor. In some embodiments, the landing sequence is automatically determined and in other embodiments, the landing sequence is manually determined or manually modified.

After track pairs are determined, the separation distance between the aircraft in a track pair is determined in step 508. The separation distances are generated by assuming each aircraft is at the same altitude.

In step 510, a user interface is generated or updated to display information for the approaching aircraft including the separation distance for the track pairs. For example, as explained above, a user interface may include a graphical representation for each aircraft that is included in the predefined awareness zone and may include, proximate to each representation, textual and graphical information relevant to the associated aircraft.

The separation distance for a track pair may be displayed next to the representation of the trailing aircraft of the track pair, for example, in the form of a numerical value with a predefined unit of measure (e.g., nautical miles). In some embodiments, the textual information may include graphical characteristics that may change based on predefined criteria when the aircraft enter the alerting zone. For example, a font color of the text may change, or the text may flash, to warn or alert an air traffic controller that the separation distance has dropped or is predicted to drop below a predetermined level.

The graphical information may be in the form of an arrow whose length is based on a minimum separation required between the aircraft that the arrow is associated with and the aircraft immediately in front of it in terms of landing sequence. The arrow can be oriented in accordance with the heading of the aircraft and its length can be proportional to the minimum separation distance for the given aircraft pair. When the aircraft enter the alerting zone, one or more characteristics of an arrow may change based on the predicted separation distance. For example, a green arrow may change to yellow if there is a predicted loss of required separation within a predetermined time threshold. A yellow arrow may change to red if there is a predicted loss of required separation within an even shorter predetermined time threshold.

In some embodiments, characteristics of one or more arrows can be based on geography in the vicinity of the aircraft, altitude, destination airport, or any other information that may aid an air traffic controller in controlling the approach of aircraft to an airport or group of airports. In some embodiments, arrows are displayed for all aircraft that are included in an awareness zone. In some embodiments, there are multiple awareness zones and the display of aircraft information (such as arrows) may be based on a configuration that is specific to a particular awareness zone. For example, a first awareness zone may encompass at least some of the final approach course and a second awareness zone may be further out relative to the final approach course from the first awareness zone. More information may be displayed for aircraft within the first awareness zone than for those within the second awareness zone. For example, arrows may be displayed for the first awareness zone but not for the second awareness zone. An additional zone called the alerting zone can be defined even closer to the airport in which alerts are presented based on predicted losses in separation. In some embodiments, a narrow boundary around the final approach course defines the alerting zone.

In some embodiments, controllers may be given the ability to quickly toggle individual required separation indicator (and/or any other information displayed for a given aircraft) on and off, for example, with a hot key or click. If a controller turns an indicator off, the indicator can remain off for the remainder of the flight or unless the indicator is alerting (i.e., it turns yellow or red based on a predicted loss of separation).

In some embodiments, one or more modes can change information displayed for all aircraft in the awareness zone. For example, a hover mode can display required separation indicators and/or other approach information only when an aircraft is selected (and only for the selected aircraft). The selection may be made via a hover of a mouse or finger or through a click or tap, for example. A full suppression mode can only display required separation indicators and/or other information when an alert is triggered (e.g., to indicate predicted loss of minimum separation).

According to some embodiments, a global required separation indicator intensity control can give the controller the ability to increase or decrease the transparency of the indicators and/or other displayed information to their liking. Users can save this intensity level to their profile.

As explained above, the separation distance between two aircraft of a track pair is determined and displayed on the user interface of the early separation awareness system and the aircraft that are associated with a track pair is determined based on the landing sequence of the aircraft. In some embodiments, this sequence is determined by one or more external systems (e.g., arrival management system) and communicated to the early separation awareness system. In other embodiments, the early separation awareness system generates landing sequencing instead of or in addition to an external system.

In some embodiments, the landing sequence for approaching aircraft is determined, in part, by calculating the distance of the aircraft to the runway. The distance may be a straight line or may be based on the flight plan of the aircraft. Flight plans may be stored by the early separation awareness system or may be stored by one or more separate systems that manage flight plans and communicated to the early separation awareness system. In some embodiments, parameters can be added to increase distance based on, for example, the concentration of aircraft within a defined region, or based on forecasted demand within a given aircraft's arrival time window. The speeds of the aircraft are then used to determine the amount of time to arrival and landing sequence is assigned based on the estimated arrival time.

In some embodiments, one or more adaptive methods (e.g., artificial intelligence) are used to learn controllers' sequencing characteristics and the sequencing algorithm is adapted accordingly. For example, a controller may favor downwind traffic over straight-in traffic or vice-versa.

In some embodiments, controllers can manually change the sequencing, for example, when the sequence generated by the system does not match a controller's plan. In this case, the controller can adjust the sequence based on their needs through the user interface and the separation distance, required separation indicator lengths, etc., will update based on the updated pairings. In some embodiments, a sequence may be changed via a user input that is associated with the representation of the aircraft for which the sequence is to be changed. For example, the controller can select the representation of an aircraft on the user interface and enter in a new sequence number for the selected representation. Sequences of the other aircraft would automatically update accordingly (i.e., shifting forward or back in the sequence by one aircraft).

In some embodiments, a notification appears on the required separation indicator for an aircraft that instructs the controller when to turn the aircraft off of the downwind leg (i.e., traveling parallel to the runway in the opposite direction of arrival operations) towards the final approach. The indicator can appear when the aircraft can turn and still maintain separation from the aircraft it is following. In some embodiments, the indicator is in the form of a flashing required separation mileage number. In some embodiments, the algorithm to determine when to display the indicator could incorporate winds, aircraft type (i.e., different aircraft can be modeled to turn at different rates), or any other approach related factor. At each time step, the path of the aircraft can be projected forward on the downwind as if it were to begin its turn and a determination can be made whether the aircraft would have enough space behind its leading aircraft based on its predicted path.

According to some embodiments, a curved required separation indicator can be used in place of a straight indicator to indicate a turning aircraft. The curvature of the indicator can be based on the turn rate of the aircraft, which may be a predefined value or may be determined based on tracking data. Rather than having the required separation indicators pointed in a straight line in the current heading of the aircraft, the indicator would curve indicating the predicted path of the aircraft. The shape of the indicator could illustrate the predicted path of the aircraft and may change as the aircraft progresses along its turn. The distance following the curve path of the indicator is equal to the required minimum wake turbulence separation for the aircraft pair.

Figure 6:
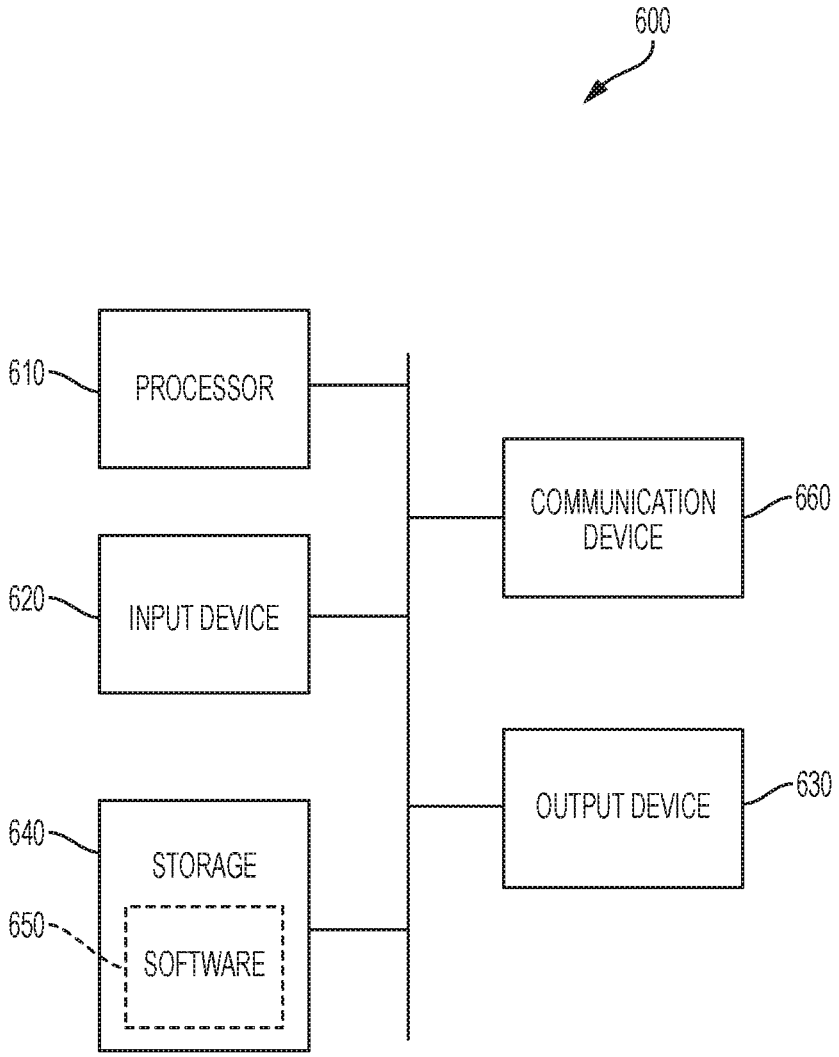
FIG. 6 illustrates a computing device, according to some embodiments.

FIG. 6 illustrates an example of a computer in accordance with one embodiment. Computer 600 can be a component of a system for displaying aircraft separation information according to the systems and methods described above, such as system 200 of FIG. 2. In some embodiments, computer 600 is configured to perform a method for displaying aircraft separation information, such as method 500 of FIG. 5. In some embodiments, computer 600 can perform other air traffic control functions, such as the display of tracking information.

Computer 600 can be a host computer connected to a network. Computer 600 can be a client computer or a server. As shown in FIG. 6, computer 600 can be any suitable type of microprocessor-based device, such as a personal computer, workstation, server, or handheld computing device, such as a phone or tablet. The computer can include, for example, one or more of processor 610, input device 620, output device 630, storage 640, and communication device 660. Input device 620 and output device 630 can generally correspond to those described above and can either be connectable or integrated with the computer.

Input device 620 can be any suitable device that provides input, such as a touch screen or monitor, keyboard, mouse, or voice-recognition device. Output device 630 can be any suitable device that provides output, such as a touch screen, monitor, printer, disk drive, or speaker.

Storage 640 can be any suitable device that provides storage, such as an electrical, magnetic, or optical memory, including a RAM, cache, hard drive, CD-ROM drive, tape drive, or removable storage disk. Communication device 660 can include any suitable device capable of transmitting and receiving signals over a network, such as a network interface chip or card. The components of the computer can be connected in any suitable manner, such as via a physical bus or wirelessly. Storage 640 can be a non-transitory computer readable storage medium comprising one or more programs, which, when executed by one or more processors, such as processor 610, cause the one or more processors to perform methods described herein, such as method 500 of FIG. 5.

Software 650, which can be stored in storage 640 and executed by processor 610, can include, for example, the programming that embodies the functionality of the present disclosure (e.g., as embodied in the systems, computers, servers, and/or devices as described above). In some embodiments, software 650 can include a combination of servers such as application servers and database servers.

Software 650 can also be stored and/or transported within any computer-readable storage medium for use by or in connection with an instruction execution system, apparatus, or device, such as those described above, that can fetch instructions associated with the software from the instruction execution system, apparatus, or device and execute the instructions. In the context of this disclosure, a computer-readable storage medium can be any medium, such as storage 640, that can contain or store programming for use by or in connection with an instruction execution system, apparatus, or device.

Software 650 can also be propagated within any transport medium for use by or in connection with an instruction execution system, apparatus, or device, such as those described above, that can fetch instructions associated with the software from the instruction execution system, apparatus, or device and execute the instructions. In the context of this disclosure, a transport medium can be any medium that can communicate, propagate, or transport programming for use by or in connection with an instruction execution system, apparatus, or device. The transport readable medium can include, but is not limited to, an electronic, magnetic, optical, electromagnetic, or infrared wired or wireless propagation medium.

Computer 600 may be connected to a network, which can be any suitable type of interconnected communication system. The network can implement any suitable communications protocol and can be secured by any suitable security protocol. The network can comprise network links of any suitable arrangement that can implement the transmission and reception of network signals, such as wireless network connections, T1 or T3 lines, cable networks, DSL, or telephone lines.

Computer 600 can implement any operating system suitable for operating on the network. Software 650 can be written in any suitable programming language, such as C, C++, Java, or Python. In various embodiments, application software embodying the functionality of the present disclosure can be deployed in different configurations, such as in a client/server arrangement or through a Web browser as a Web-based application or Web service, for example.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated by reference.

What is claimed as new and desired to be protected by Letters Patent of the United States is:

1. An aircraft separation system comprising:

a display for displaying a user interface;

one or more processors;

memory; and one or more programs, wherein the one or more programs are stored in the memory and configured to be executed by the one or more processors, the one or more programs including instructions for:

receiving tracking data for a plurality of aircraft from one or more tracking systems;

establishing a three-dimensional awareness zone, wherein the three-dimensional awareness zone is configured to encompass at least a portion of a final approach course;

determine that the determining that a first aircraft of the plurality of aircraft and a second aircraft of the plurality of aircraft are in the three-dimensional awareness zone based on the tracking data;

determining a first track pair in the three-dimensional awareness zone comprising the first aircraft and the second aircraft, wherein the first aircraft is on a first heading and the second aircraft is on a second heading that is different from the first heading, wherein the first track pair is determined based on a landing sequence of the first and second aircraft on a runway associated with the final approach course;

determining a separation distance between the first aircraft and the second aircraft of the first track pair; and in response to determining that the first and second aircraft are in the three-dimensional awareness zone, displaying, in the user interface, a graphical representation of the first aircraft, a graphical representation of the second aircraft, and an indication of the separation distance between the first aircraft and the second aircraft, wherein the indication is displayed proximate to the graphical representation of the second aircraft.

2. The system of claim 1, wherein the tracking data comprises latitude, longitude, and altitude.

3. The system of claim 2, wherein determining that the first and second aircraft are in the three-dimensional awareness zone includes determining that altitudes of the first and second aircraft are less than a pre-determined threshold.

4. The system of claim 1, wherein the tracking data comprises headings for the plurality of aircraft, and wherein determining that the first and second aircraft are in the three-dimensional awareness zone includes determining that headings of the first and second aircraft are within a pre-determined range of headings.

5. The system of claim 4, wherein the pre-determined range is relative to a heading of the final approach course.

6. The system of claim 1, wherein the one or more programs include instructions for:

receiving tracking data for a third aircraft from one or more tracking systems;

determining that the third aircraft is in the three-dimensional awareness zone based on the tracking data for the third aircraft;

determining a second track pair in the three-dimensional awareness zone, wherein the second track pair comprises the second aircraft having the second heading and the third aircraft having a third heading, wherein the third heading is different from the first heading and the second heading;

determining a separation distance between the second aircraft and the third aircraft of the second track pair; and automatically updating the user interface to display a graphical representation of the third aircraft and an indication of the separation distance between the second aircraft and the third aircraft displayed proximate to the representation of the third aircraft.

7. The system of claim 1, wherein the user interface includes a graphical indication of a minimum separation distance for the second aircraft.

8. The system of claim 7, wherein the graphical indication of the minimum separation distance for the second aircraft is an indicator displayed proximate to the representation of the second aircraft.

9. The system of claim 8, wherein a size of the indicator is proportional to the minimum separation distance.

10. The system of claim 7, wherein the graphical indication of the minimum separation distance for the second aircraft indicates a heading for the second aircraft.

11. The system of claim 7, wherein the one or more programs include instructions for alerting a user when the second aircraft has entered a predefined alerting zone and there is a predicted loss of separation between the first aircraft and the second aircraft within a predetermined time or when the separation distance between the first aircraft and the second aircraft is within a pre-determined threshold of the minimum separation distance of the second aircraft.

12. The system of claim 1, wherein a size and shape of the three-dimensional awareness zone is user configurable.

13. The system of claim 1, wherein the user interface includes an indication of landing sequence, aircraft type, and wake turbulence category associated with the second aircraft and the indication is displayed proximate to the representation of the second aircraft.

14. The system of claim 1, wherein the one or more programs include instructions for receiving updated tracking data and automatically updating the user interface based on the updated tracking data.

15. The system of claim 1, wherein the three-dimensional awareness zone is associated with a configuration specifying what aircraft information to display in the user interface, and wherein display of the indication and the graphical representations of the first and second aircraft is based on the configuration associated with the three-dimensional awareness zone.

16. A method of displaying aircraft separation on a user interface displayed on a display of an air traffic control system comprising:

receiving tracking data for a plurality of aircraft from one or more tracking systems;

establishing a three-dimensional awareness zone, wherein the three-dimensional awareness zone is configured to encompass at least a portion of a final approach course;

determining that a first aircraft of the plurality of aircraft and a second aircraft of the plurality of aircraft are in the three-dimensional awareness zone based on the tracking data;

determining a first track pair in the three-dimensional awareness zone comprising the first aircraft and the second aircraft, wherein the first aircraft is on a first heading and the second aircraft is on a second heading that is different from the first heading, wherein the first track pair is determined based on a landing sequence of the first and second aircraft on a runway associated with the final approach course;

determining a separation distance between the first aircraft and the second aircraft of the first track pair; and in response to determining that the first and second aircraft are in the three-dimensional awareness zone, displaying, in the user interface, a graphical representation of the first aircraft, a graphical representation of the second aircraft, and an indication of the separation distance between the first aircraft and the second aircraft, wherein the indication is displayed proximate to the graphical representation of the second aircraft.

17. The method of claim 16, wherein the tracking data comprises latitude, longitude, and altitude.

18. The method of claim 17, wherein determining that the first and second aircraft are in the three-dimensional awareness zone includes determining that altitudes of the first and second aircraft are less than a pre-determined threshold.

19. The method of claim 16, wherein the tracking data comprises headings for the plurality of aircraft, and wherein determining that the first and second aircraft are in the three-dimensional awareness zone includes determining that headings of the first and second aircraft are within a pre-determined range of headings.

20. The method of claim 19, wherein the pre-determined range is relative to a heading of the final approach course.

21. The method of claim 16, further comprising:

receiving tracking data for a third aircraft from one or more tracking systems;

determining that the third aircraft is in the three-dimensional awareness zone based on the tracking data for the third aircraft;

determining a second track pair in the three-dimensional awareness zone, wherein the second track pair comprises the second aircraft having the second heading and the third aircraft having a third heading, wherein the third heading is different from the first heading and the second heading;

determining a separation distance between the second aircraft and the third aircraft of the second track pair; and automatically updating the user interface to display a graphical representation of the third aircraft and an indication of the separation distance between the second aircraft and the third aircraft displayed proximate to the representation of the third aircraft.

22. The method of claim 16, wherein the user interface includes a graphical indication of a minimum separation distance for the second aircraft.

23. The method of claim 22, wherein the graphical indication of the minimum separation distance for the second aircraft is an indicator displayed proximate to the representation of the second aircraft.

24. The method of claim 23, wherein a size of the indicator is proportional to the minimum separation distance.

25. The method of claim 22, wherein the graphical indication of the minimum separation distance for the second aircraft indicates a heading for the second aircraft.

26. The method of claim 22, further comprising alerting a user when the second aircraft has entered a predefined alerting zone and there is a predicted loss of separation between the first aircraft and the second aircraft within a predetermined time or when the separation distance between the first aircraft and the second aircraft is within a predetermined threshold of the minimum separation distance of the second aircraft.

27. The method of claim 16, wherein a size of the three-dimensional awareness zone is user configurable.

28. The method of claim 16, wherein the user interface includes an indication of landing sequence, aircraft type, and wake turbulence category associated with the second aircraft and the indication is displayed proximate to the representation of the second aircraft.

29. The method of claim 16, further comprising receiving updated tracking data and automatically updating the user interface based on the updated tracking data.

30. A non-transitory computer readable storage medium comprising one or more programs, which when executed by a system with a display, cause the system to:

receive tracking data for a plurality of aircraft from one or more tracking systems;

establish a three-dimensional awareness zone, wherein the three-dimensional awareness zone is configured to encompass at least a portion of a final approach course;

determine that a first aircraft of the plurality of aircraft and a second aircraft of the plurality of aircraft are in the three-dimensional awareness zone based on the tracking data;

determine a first track pair in the three-dimensional awareness zone comprising the first aircraft and the second aircraft, wherein the first aircraft is on a first heading and the second aircraft is on a second heading that is different from the first heading, wherein the first track pair is determined based on a landing sequence of the first and second aircraft on a runway associated with the final approach course;

determine a separation distance between the first aircraft and the second aircraft of the first track pair; and in response to determining that the first and second aircraft are in the three-dimensional awareness zone, display, in the user interface, a graphical representation of the first aircraft, a graphical representation of the second aircraft, and an indication of the separation distance between the first aircraft and the second aircraft, wherein the indication is displayed proximate to the graphical representation of the second aircraft.

* * * * *